US005941139A

United States Patent [19]

Vodehnal

[11] Patent Number: 5,941,139

[45] Date of Patent: Aug. 24, 1999

[54] TUNER SCREWDRIVER

[76] Inventor: Robert Wayne Vodehnal, 475 30 Rd., Grand Junction, Colo. 81504

[21] Appl. No.: 08/921,061

[22] Filed: Aug. 29, 1997

[51] Int. Cl.[6] ..... B25B 13/00

[52] U.S. Cl. ..... 81/57.43; 81/177.6

[58] Field of Search ..... 81/57.43, 177.6

[56] References Cited

U.S. PATENT DOCUMENTS

| | | | |
|---|---|---|---|
| 2,814,322 | 11/1957 | Kupfrian | 81/177.6 |
| 3,080,900 | 3/1963 | Rosenberg . | |
| 3,585,885 | 6/1971 | Carr | 81/177.6 |
| 4,951,533 | 8/1990 | Hillinger . | |
| 4,974,477 | 12/1990 | Anderson . | |
| 5,349,886 | 9/1994 | Jin . | |
| 5,572,913 | 11/1996 | Nasiell | 81/177.6 |
| 5,638,726 | 6/1997 | Pelkonen et al. | 81/57.43 |

*Primary Examiner*—David A. Scherbel
*Assistant Examiner*—Daniel G. Shanley
*Attorney, Agent, or Firm*—Patent & Trademark Services; Thomas Zack; Joseph H. McGlynn

[57] ABSTRACT

An bit driver apparatus having three joined hollow tubular sections with a flexible cable member extending through the hollow portions usable when tight turning adjustments are needed, such as in motorcycle carburetor adjustments. A rotatable handle is fixed to one of the cable's ends and a magnetic bit holder is located within the opposite hollow section such that rotation of the handle causes the holder and its mounted bit to rotate and turn an engaged screw or nut. The second joining hollow second between the other sections is bent at an angle of about 45 degrees with respect to the first handle section and the third bit holder second is joined to the second section at about the same angle but extending in the reverse direction. A supporting outer sleeve provides lateral support for the bit while in its holder.

3 Claims, 1 Drawing Sheet

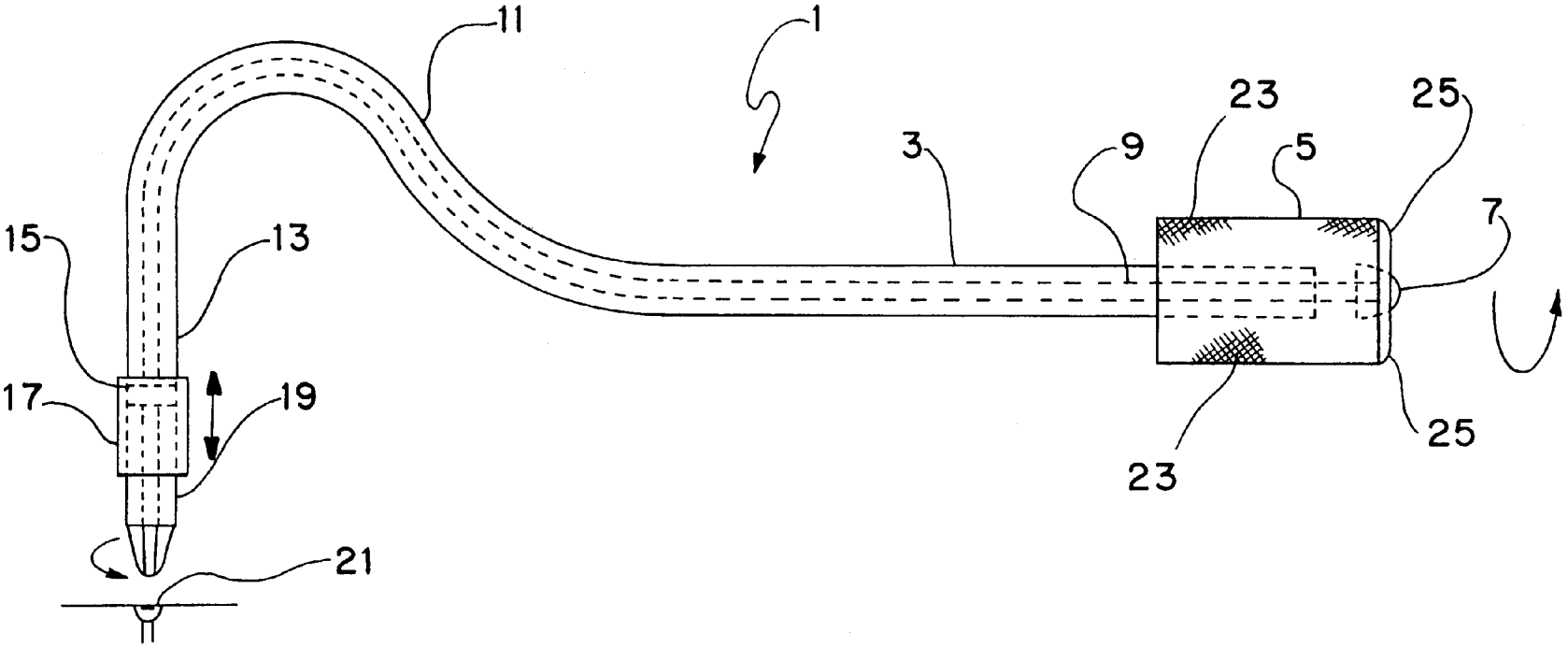
1
3
5
7
9
11
13
15
17
19
21
23
23
25
25

TUNER SCREWDRIVER

BACKGROUND OF THE INVENTION

Whenever there is a screw to be tighten there is a need for some type of implement to tighten or loosen the screw. Normally, this action is performed by a screwdriver having a rotatable straight elongate rigid shaft with a nut or screw engaging end bit. In some case, a gear driven ratchet mechanism has been used to increase the amount of force applied to the nut or screw head by the engaging end bit. For most purposes such bit mechanisms have proven useful and practical for their intended head moving use.

When a nut or screw head is positioned in a hard to reach locations, such as the confined spaces for adjusting the carburetor screw of a motorcycle or servicing computers or television sets, the drive shaft of the screwdriver has been offset from its handle to permit the engagement of the bit end with the nut's or screw's head. The present invention relates to one such screw or nut driver device having an elongated first straight hollow handle section with a joining bent second hollow section and a terminal straight third hollow offset section with a bit offset end at approximately 90 degrees form the first section with an interior cable member to permit rotation of the bit as set forth in this specification.

DESCRIPTION OF THE PRIOR ART

Screw or nut driver units of various configurations are known. For example, in U.S. Pat. No. 3,080,900 to Rosenberg a ratchet screwdriver is disclosed usable in cramped locations having a bent pistol type grip handle with an offset screwdriver blade. In the U.S. Pat. No. 4,951,533 to Hillinger suction cups are placed on the handle's gripping surface to increase its grip.

The Anderson reference (U.S. Pat. No. 4,974,477) has an S-curve shaft which causes the axis of the tool to intersect the axis of the handle to cause a cone-shaped pattern of rotation.

In the U.S. Pat. No. 5,349,886 to Jin an offset shank has a tip at its lower end and a bent twice Z-shape with a biasing member in the hole of the handle.

The present invention is directed to an offset shank screw or nut driver having a straight elongated hollow handle section joined to a bent second hollow section and third hollow bit joining section offset approximately ninety degrees with respect to the first section. A cable member runs through each of the three hollow sections from near the handle's end to engage the rotatable bit holder as more further set forth in this specification.

SUMMARY OF THE INVENTION

This invention relates to an offset driver for a screw or nut head finding particular usefulness in tight places where normal straight shaft drivers cannot be used.

It is the primary object of the present invention to provide for an improved driver offset driver for a screwdriver or nut driver apparatus.

Another object is to provide for such an apparatus wherein a small angular rotation of the bit engaged member may be made by the finger rotating of an internal cable member attached to the drive.

These and other objects and advantages of the present invention will become apparent to readers from a consideration of the ensuing description and the accompanying drawings.

BRIEF DESCRIPTION OF THE DRAWINGS

The FIGURE is a side view of the invention's preferred embodiment.

DESCRIPTION OF THE PREFERRED EMBODIMENT

The driver 1 consist of three joined hollow tubular sections. The straight cylindrical hollow handle tubular section 3 has an enlarged finger operated end 5 extending around its outer surface and joined at its end by a weld 7 to an internal flexible cable 9 within the section. By rotating the end 5 relative to the section 3, the attached cable 9 rotates in the same direction within the section.

Cable 9 extends from its welded rear end 7 through the hollow exterior of section 3 to the hollow interior of the joining hollow bent tubular section 11 to the joined hollow straight third bit holding tubular section 13. At its front end cable 9 is fixed to the rear of the cylindrical closed end magnet bit holder 15 and rotatable therewith. The front opened holder is configured in cross section to engage the rear of the mounted bit, for example, if the bit were square, hexagonal, etc. then the holder would have the same shape to insure it will rotate in unison with the holder. An exterior larger diameter socket sleeve 17 extends around the diameter of the bit holder and provides lateral stability to the interior holder and its mounted extending interchangeable driven bit 19 held at its rear end by the magnetic attraction of the holder 15.

The holder enclosing cylindrical hollow sleeve 17 is somewhat longer in length than the holder and both are opened at their front ends. This sleeve may have internal threads to engage external threads embedded into on the surface of the front end of section 13 to retain it in place and permit the sleeve's adjustment lengthwise of this section. A user by rotating the handle 5 with its fingers causes the attached cable 9 and bit holder 15 to rotate in the same direction. This in turn causes a mounted bit, such as the shown Philips bit 19 to rotate, which then rotates an engaged screw or nuts such as the depicted Philips head screw member 21. Almost any type of screw or nut head can be so engaged, depending on the type of inserted interchangeable bit 19 mounted in the bit holder 15.

Bent hollow tubular section 11 joins straight hollow tubular section 3 at an upwardly disposed angle of approximately 45 degrees and then bends again to achieve a reverse downward direction of approximately 45 degrees such that the third joining hollow tubular drive section 13 is oriented approximately at a ninety degree or right angle with respect to the first hollow section 3. The three joined tubular hollow portions and sections may be a single unitary continuous structure constructed as one unit. One method to form such as a unit is by molding the joined sections together by the plastic injection molding process.

Other shown features include a surface indentation pattern 23 located on the handle end 5 to insure an easy finger grip and 45 degree beveled side edges 25 on this end. The length of the joined tubular hollow sections can vary. In some embodiments the first section 3 was between about 5 inches long to up to 12 inches to where it met the joined bent section 11. Total lengths of all joined sections can be up to about 2 feet.

It should be clear that the unique bent design of the bit driver tool allows its use in hard to reach places where conventional bit driver units are incapable of functioning. In particular it finds applicability to those situations where a light or fine tuning adjustment is needed to a screw or nut and rotating the outer shank is not possible or impractical. One example for its use, is in the tuning of the adjustment screw on the carburetor of a motorcycle. Other tight fit examples where the invention finds applicability include those performed by electrical or computer technicians where on site servicing is needed for the screws or nuts of such items.

Although the present invention's preferred embodiment and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A bit driver apparatus comprising:

a first substantially straight section having a hollow interior portion;

a handle rotatably mounted on one end of said first section;

said first section having a second end remote from said handle;

a second section having a first end joined to said first section at the second end;

said second section having a hollow interior portion communicating with the hollow interior portion of said first section;

said second section having a second end remote from the end where joined to said first section;

said first and second sections being joined at an upward angle of approximately a forty-five degrees;

a third section having a first end and a second end, said third section being joined to said second section at the second end of said said second section;

said third section having a hollow interior portion communicating with the hollow interior portion of said second section;

said first end of said third section being joined to said second end of said second section;

said third section being oriented at a downward angle of approximately ninety degrees from where joined to said second section;

a cable member having a first end and a second end;

said first end of said cable member being non-rotatably fixed to said handle;

said cable member extending through the hollow interior portions of said first section, said second section and said third section;

said second end of said cable member having a bit holder non-rotabtably fixed thereto; and a sleeve mounted on the second end of said first section and extending over the bit holder, said sleeve being movable lengthwise of said first section and the bit holder to provide lateral stability between a held bit and in the bit holder when rotation is imparted to the handle.

2. The apparatus as claimed in claim 1, wherein said bit holder is magnetic such that it can attract and hold a magnetically attractable bit mounted therein.

3. The apparatus as claimed in claim 1, wherein said three joined sections are formed as one unitary structure.

* * * * *